US006296071B1

(12) United States Patent
Runte et al.

(10) Patent No.: US 6,296,071 B1
(45) Date of Patent: Oct. 2, 2001

(54) MOTORCYCLE ROCKER ASSEMBLY

(75) Inventors: Richard M. Runte, Lisbon; Henry Hubbard, Menomonee Falls; R. Bruce Dennert, Waukesha, all of WI (US)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 0 days.

(21) Appl. No.: 09/655,361

(22) Filed: Sep. 5, 2000

Related U.S. Application Data

(63) Continuation of application No. 09/112,619, filed on Jul. 9, 1998, now abandoned.
(60) Provisional application No. 60/091,264, filed on Jun. 30, 1998.

(51) Int. Cl.[7] ..... B62D 61/02
(52) U.S. Cl. ..... 180/219; 123/90.33
(58) Field of Search ..... 180/219; 123/90.1–90.37, 123/41.86, 195 C, 90.6

(56) References Cited

U.S. PATENT DOCUMENTS

| | | | |
|---|---|---|---|
| 2,982,273 | | 5/1961 | Bergmann . |
| 3,270,727 | | 9/1966 | Nance . |
| 3,712,278 | | 1/1973 | Kuhn . |
| 3,949,724 | | 4/1976 | Nickly . |
| 4,327,678 | | 5/1982 | Pollet . |
| 4,438,734 | | 3/1984 | Hayashi . |
| 4,459,966 | | 7/1984 | Sakano et al. . |
| 4,538,561 | | 9/1985 | Amemori et al. . |
| 4,538,734 | | 9/1985 | Gill . |
| 4,602,595 | | 7/1986 | Aoki et al. . |
| 4,602,607 | | 7/1986 | Balsley . |
| 4,686,945 | | 8/1987 | Inagaki et al. . |
| 4,686,946 | | 8/1987 | Umeda et al. . |
| 4,721,075 | | 1/1988 | Kasai . |
| 4,730,579 | | 3/1988 | Yamada et al. . |
| 4,881,496 | * | 11/1989 | Kronich ..... 123/90.33 |
| 4,911,120 | | 3/1990 | Sumi . |
| 4,916,704 | | 4/1990 | Bruckert et al. . |
| 4,920,930 | | 5/1990 | Sakano et al. . |
| 4,969,434 | | 11/1990 | Nakagawa . |

(List continued on next page.)

FOREIGN PATENT DOCUMENTS

| | | |
|---|---|---|
| 4326332 | 2/1995 | (DE) . |
| 0580350A1 | 1/1994 | (EP) . |
| 0691619A2 | 1/1996 | (EP) . |
| 0693836A1 | 1/1996 | (EP) . |
| 0695997A2 | 2/1996 | (EP) . |
| 0738058A2 | 10/1996 | (EP) . |
| 0752786A1 | 1/1997 | (EP) . |
| 0766184A2 | 4/1997 | (EP) . |
| 0782296A2 | 7/1997 | (EP) . |
| 0792044A2 | 8/1997 | (EP) . |

OTHER PUBLICATIONS

Custom Chrome Catalog 1994–pp. 362–364.

*Primary Examiner*—Christopher P. Schwartz
*Assistant Examiner*—C. T. Bartz
(74) *Attorney, Agent, or Firm*—Michael Best & Friedrich LLP

(57) ABSTRACT

A rocker assembly includes a base member having opposite ends, a flange interconnected with each of the opposite ends, a pair of rocker arm support shafts supported by the flanges, and a rocker arm interconnected with each rocker arm support shaft for rotation with respect to the rocker arm support shaft about a longitudinal axis. The rocker assembly is housed in a rocker box housing, is removable from the rocker box housing, and is mounted directly on the cylinder head of a motorcycle. The rocker box housing includes a generally wedge-shaped cover and a generally wedge-shaped base to allow the cover to be removed from the base in a generally horizontal direction.

24 Claims, 3 Drawing Sheets

U.S. PATENT DOCUMENTS

| | | |
|---|---|---|
| 4,995,352 | 2/1991 | Machino . |
| 5,058,542 | 10/1991 | Grayson et al. . |
| 5,095,861 | 3/1992 | Dove, Jr. . |
| 5,224,163 | 6/1993 | Gasser et al. . |
| 5,235,642 | 8/1993 | Wobber et al. . |
| 5,297,506 | 3/1994 | Reckzugel et al. . |
| 5,339,778 | 8/1994 | Reckzugel et al. . |
| 5,365,589 | 11/1994 | Gutowitz . |
| 5,365,900 | 11/1994 | Franlund et al. . |
| 5,421,292 | 6/1995 | Hoffman et al. . |
| 5,557,678 | 9/1996 | Ganesan . |
| 5,560,331 | 10/1996 | Komatsu et al. . |
| 5,577,209 | 11/1996 | Boyle et al. . |
| 5,604,801 | 2/1997 | Dolan et al. . |
| 5,613,012 | 3/1997 | Hoffman et al. . |
| 5,615,268 | 3/1997 | Bisbee et al. . |
| 5,638,446 | 6/1997 | Rubin . |
| 5,931,131 | 8/1999 | Hackett . |
| 5,988,125 | 11/1999 | Hara et al. . |

* cited by examiner

FIG. 2
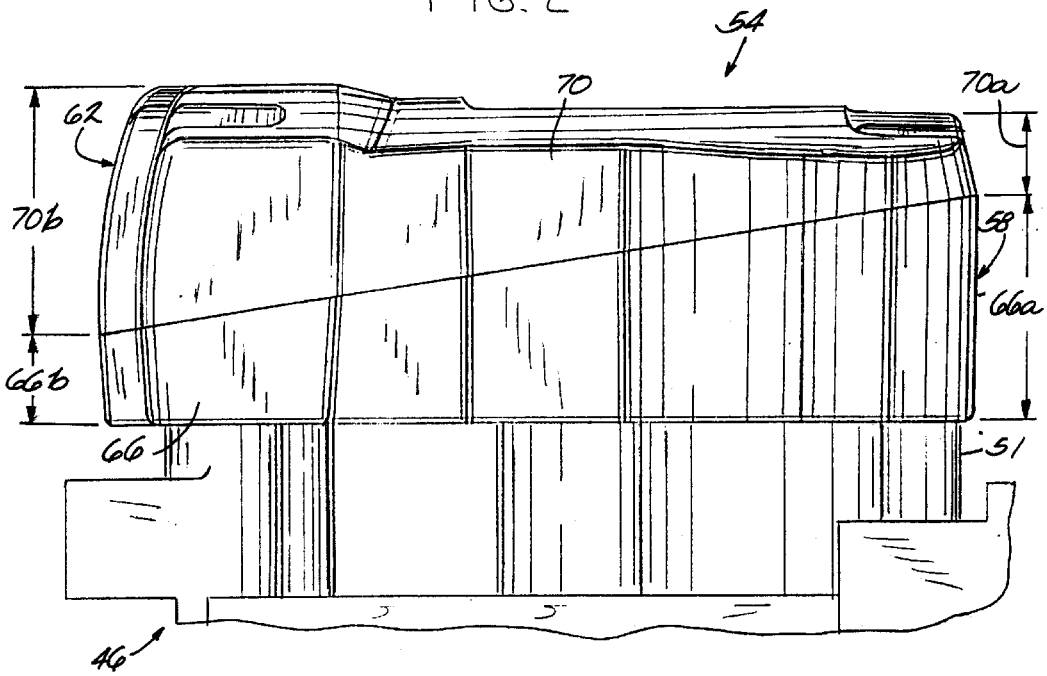
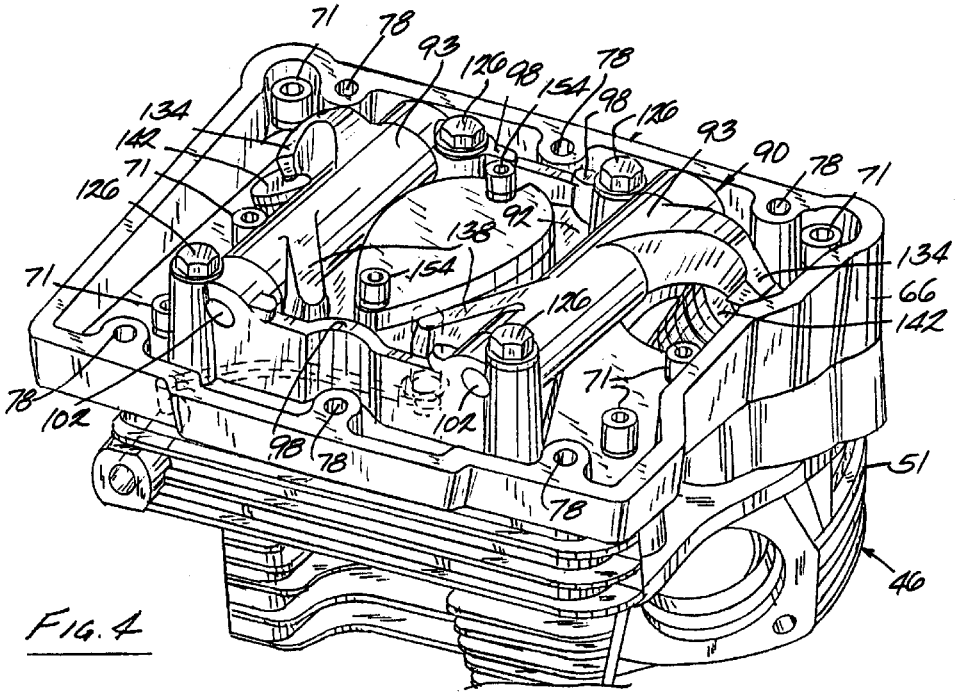
FIG. 4

MOTORCYCLE ROCKER ASSEMBLY

This application is a continuation of application Ser. No. 09/112,619, filed Jul. 9, 1998, now abandoned the entire contents of which are incorporated herein by reference, which claims the benefit of Provisional Application No. 60/091,264, filed Jun. 30, 1998.

FIELD OF THE INVENTION

This invention relates to motorcycle internal combustion engines, and more particularly to a rocker assembly for a motorcycle internal combustion engine.

BACKGROUND OF THE INVENTION

Motorcycle engines typically have either overhead cam or push rod valve operation. With push rod valve operation, the push rods typically operate rocker assemblies, each having a rocker mounted to a rocker support. The rocker assemblies are positioned within a rocker box mounted above a cylinder assembly (i.e., a cylinder and cylinder head). The rocker box includes a lower section that is formed integrally with the rocker supports, and an upper section that completes the enclosure for the rocker assemblies.

When the engine is mounted in the frame of some motorcycles, the rocker box is positioned very close to one of the frame members. Such close proximity requires that the entire engine be removed from the frame in order to remove the upper section of the rocker box to have access to the rocker assemblies. In this regard, it is known to produce the upper section of the rocker box in two portions: a middle portion and an upper portion. Because each of the two portions is thinner than the one-piece upper section, they can be removed from the engine one at a time while the engine is mounted in the frame.

SUMMARY OF THE PRESENT INVENTION

The present invention provides a rocker assembly removably housed in or separable from a rocker box, and mounted on a cylinder assembly of a motorcycle engine. By virtue of this design, the entire rocker assembly (including the rocker support) can be removed from the rocker box (e.g., the lower section) so that repairs and/or replacement of the rocker assembly can be performed more efficiently. That is, the rocker support can be replaced without the need to also remove and replace the lower section of the rocker box. In addition, since the lower section does not need to be removed when removing the rocker support, the gasket between the lower section and the cylinder head can stay intact, thereby further saving time and money.

In one embodiment, the rocker assembly includes a rocker support and a rocker supported by the rocker support. The rocker support includes a base having opposite ends and a flange interconnected with each end of the base. Preferably, the base and flanges are made as one piece to accommodate ease of assembly while providing a common machining center.

The rocker support also includes a pair of rocker shafts, each having a longitudinal axis, mounted generally parallel to one another between the flanges. A pair of rockers are supported by the rocker support for rotation with respect to the rocker shafts about the respective longitudinal axes. Each rocker includes a first portion, arm, or actuator at one end for engaging a valve stem, and a second portion, arm, or actuator at the other end for engaging a push rod. The first portions are pivoted into engagement with the valve stems by the push rods.

In one embodiment, the rocker box is a two-piece housing having a wedge-shaped lower section or base, and a wedge-shaped upper section or cover. The cover may be separated from the base in a generally horizontal direction for ease of in-vehicle service. This allows service on components housed within the rocker box, including the rocker assembly, without removing the engine from the motorcycle frame. With this arrangement the number of rocker box gaskets has also been reduced from ten per engine down to four per engine.

Other principal features and advantages of the invention will become apparent to those skilled in the art upon review of the following drawings, the detailed description and the appended claims.

BRIEF DESCRIPTION OF THE DRAWINGS

FIG. 2 is a front elevation view of the rocker box.

FIG. 4 is a perspective view of the rocker box with the cover removed showing the rocker assembly.

DETAILED DESCRIPTION

Figure 1:
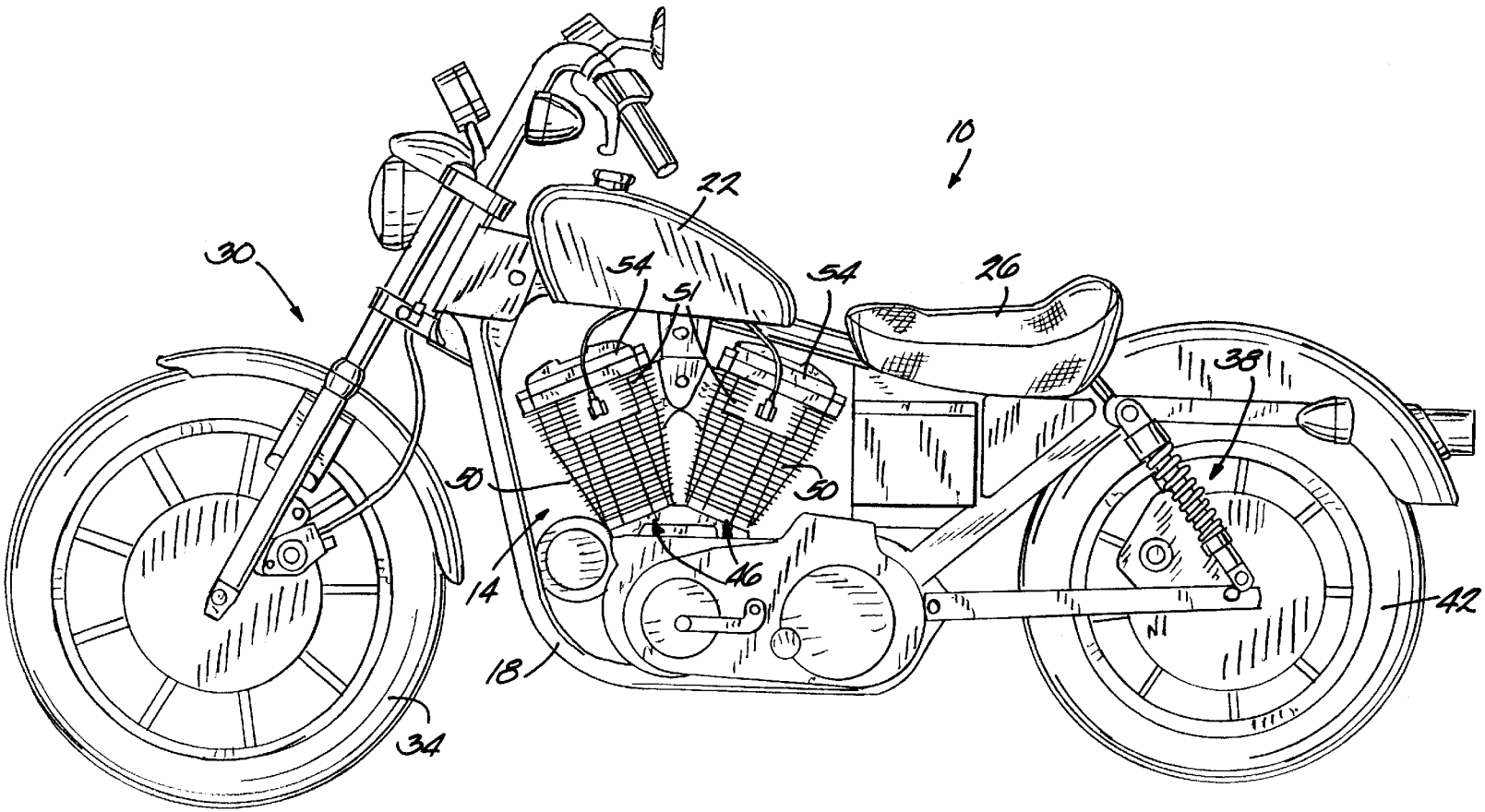
FIG. 1 is a left-side elevation view of a motorcycle including a rocker box according to the present.

FIG. 1 illustrates a motorcycle 10, which generally includes an engine 14, a frame 18, a fuel tank 22, a seat 26, a front suspension and steering assembly 30, a front wheel 34, a rear suspension assembly 38, and a rear wheel 42. The engine 14 includes first and second cylinder assemblies 46, each having an associated cylinder 50 and cylinder head 51. A rocker box 54 is mounted on each cylinder assembly 46. It will be appreciated that although the illustrated engine is a two-cylinder engine, the invention may be used with other engines having one or more cylinders.

Figure 3:
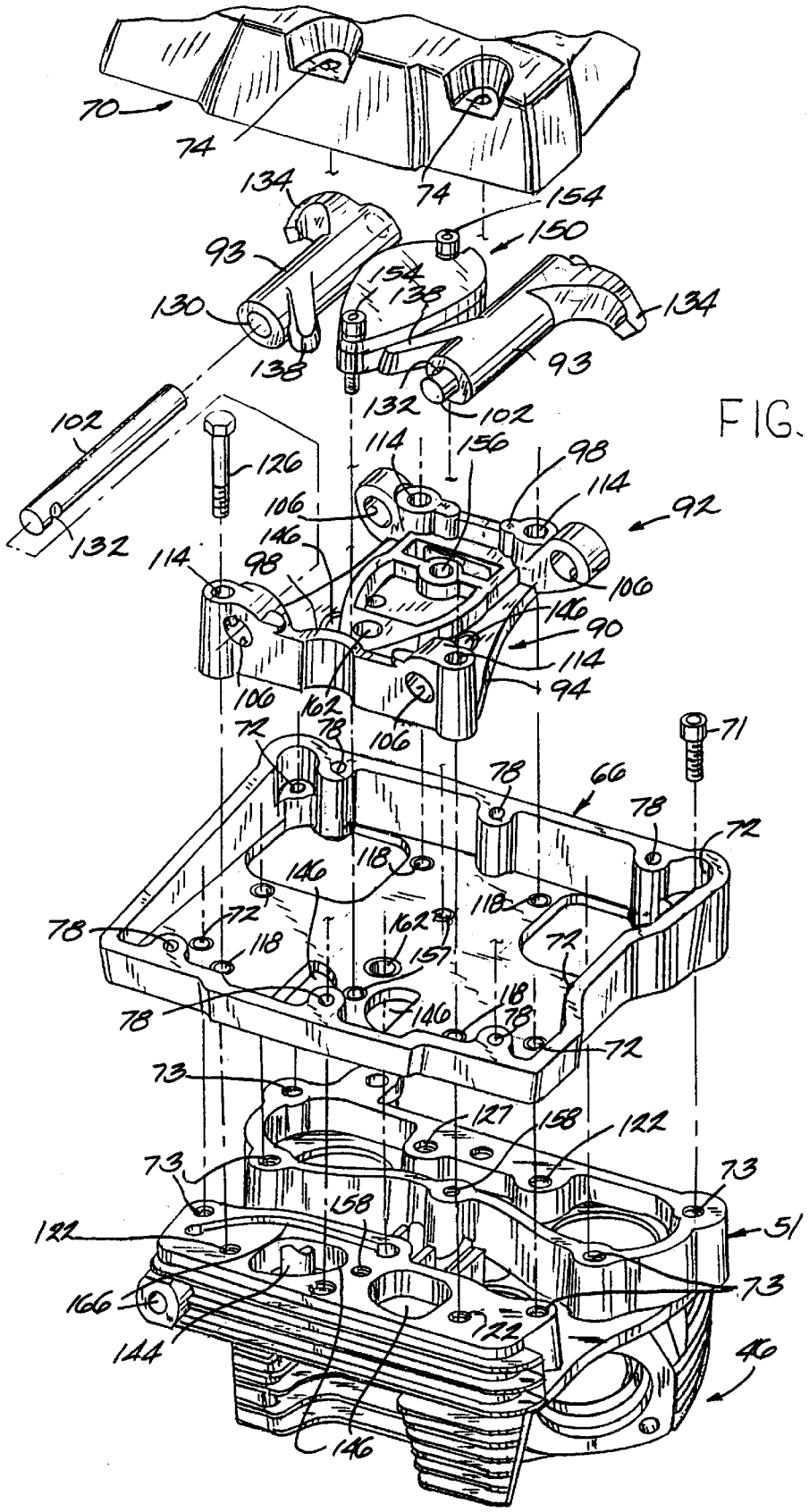
FIG. 3 is a partially-exploded view of the rocker box and rocker assembly.

FIGS. 2–4 illustrate one of the rocker boxes 54 mounted on one of the cylinder assemblies 46. The illustrated rocker box 54 has a first side 58 and a second side 62, and includes a lower section or base 66 and an upper section or cover 70. The lower section 66 is generally wedge-shaped, having a first side height 66*a* that is larger than a second side height 66*b* (i.e., the first side 58 of the lower section 66 is taller than the second side 62 of the lower section 66). The upper section 70 is also generally wedge-shaped, having a first side height 70*a* that is smaller than a second side height 70*b* (i.e., the first side 58 of the upper section 70 is shorter than the second side 62 of the upper section 70).

When in its operating position in the motorcycle 10, the first side 58 of the rocker box 54 is disposed on the left side of the motorcycle 10 and the second side 62 is disposed on the right side of the motorcycle 10. Of course, the illustrated orientations may be reversed in alternate embodiments. The lower section 66 is mounted on the cylinder assembly 46 with a series of lower section fastening means. As used herein, "fastening means" includes bolts, screws, clips, and all equivalents thereof. In the illustrated embodiment, the fastening means is a mounting bolt 71 passing through apertures 72 in the lower section 66 and threaded into bores 73 in the cylinder assembly 46. The threaded portion of the bores 73 may be provided in the cylinder head 51, or extend into the cylinder 50.

A plurality of upper section apertures 74 are provided in the upper section 70. In the illustrated embodiment, corresponding threaded lower section apertures 78 are provided in the lower section 66. Fastening means, such as a threaded fastener (not shown), may be passed through each of the upper section apertures 74 and threaded into the lower section apertures 78 to close the rocker box 54.

The orientation of the rocker box 54 on the motorcycle 10 allows the upper section 70 to be removed while the rocker box 54 is mounted on the motorcycle 10. The upper section apertures 74 are positioned to allow a tool, such as a wrench or screwdriver to access the fasteners while the rocker box 54 is mounted on the motorcycle 10. The wedge shape of the upper and lower sections 70, 66 allows the upper section 70 to be removed sideways or generally horizontally, such that the frame 18 does not interfere. As used herein, "generally horizontally" and "generally horizontal direction" mean movement to the left, right, front, or rear with respect to the motorcycle with an amount of vertical movement with respect to the vehicle sufficient to clear components housed in the rocker box while not being obstructed by the frame 18.

In the illustrated embodiment, the upper section 70 may be removed in a generally horizontal direction on the right side of the motorcycle 10. The wedge shape of the lower section 66 allows visibility and access to the components in the rocker box 54 from the right side of the motorcycle 10. Therefore, the rocker box 54 allows service and maintenance to be performed on the rocker box 54 and substantially all components in the rocker box 54 while the rocker box 54 is mounted on the motorcycle 10. This allows service to be performed on the component within the rocker box 54 without breaking the seal provided by a gasket between the rocker box 54 and the cylinder head 51.

FIGS. 3 and 4 illustrate a rocker assembly 90 positioned in the rocker box 54. The rocker assembly 90 generally includes a rocker support 92 and a pair of rockers 93. The rocker support 92 comprises a base member 94, a pair of flanges 98 integrally formed or interconnected with opposite ends of the base member 94, and a pair of rocker shafts 102 sized to fit within shaft support bores 106 in the flanges 98. The base member 94 may be a cast member, and the flanges 98 may be interconnected with the base member 94 by welding, fastening, integrally casting, or another suitable joining method.

Each flange 98 includes a pair of through-bores 114. In the illustrated embodiment, the through-bores 114 align with clearance apertures 118 in the lower section 66 and threaded apertures 122 in the cylinder assembly 46. Suitable fastening means are used to mount the rocker assembly to the lower section or cylinder assembly. In the illustrated embodiment, the fastening means are rocker assembly mounting bolts 126 which pass through the through-bores 114, then through the clearance apertures 118, and then thread into the threaded apertures 122 to secure the rocker assembly 90 within the lower section 66 and to the cylinder assembly 46. The clearance apertures 118 may alternatively be threaded, allowing the mounting bolts 126 to thread into the lower section 66. When the upper section 70 has been removed as mentioned above, sufficient clearance is provided by the wedge-shaped lower section 66 to loosen the mounting bolts 126 and remove the rocker assembly 90 from the right side of the motorcycle.

Each rocker 93 includes a longitudinally-extending bore 130. The shafts 102 are inserted into the longitudinal bores 130, and through the shaft support bores 106 in the flanges 98. In this regard, the shafts 102 support the rockers 93 for rotation with respect to the shafts 102 about the longitudinal axis of the shafts 102. In the illustrated embodiment, the support shafts 102 and rockers 93 are generally parallel with respect to each other.

A groove or indent 132 is formed adjacent one end of each shaft 102. The through-bores 114 and shaft support bores 106 in one of the flanges 98 intersect. When the shafts 102 are inserted into the shaft support bores 106, the grooves 132 align with the associated through-bore 114. When the rocker assembly mounting bolts 126 are inserted through the through-bores 114, the bolts 126 align with the grooves 132, thereby preventing the shafts 102 from sliding out of the shaft support bores 106 or rotating within the support bores 106.

Each rocker 93 includes a valve actuator arm or portion 134 on one end and a push rod actuator arm or portion 138 on the opposite side of the other end. As is generally understood, the valve actuator portions 134 are aligned with spring-actuated valve heads 142 (FIG. 4). The push rod actuator portions 138 are aligned with push rods 144 (one of which is shown in FIG. 3) that extend through apertures 146 in the base member 94, the lower section 66, and the cylinder assembly 46 to the cam shaft of the engine 14. The cam shaft intermittently actuates the push rods to cause the valve actuator portions 134 to cyclically actuate the valve heads 142.

A breather assembly 150 is interconnected with the rocker assembly 90 between the rockers 93. Breather fastening means 154 pass through apertures 156 in the rocker assembly 90 and apertures 157 in the lower section 66, and thread into threaded apertures 158 in the cylinder assembly 46. Alternatively, the fastening means 154 may thread into threaded apertures in the lower section 66. When properly positioned, passageways 162 in the rocker assembly 90 and lower section 66 align with a breather passage 166 in the cylinder head 51. The breather passage 166 is in fluid communication with the breather assembly 150.

Although particular embodiments of the present invention have been shown and described, other alternative embodiments will be apparent to those skilled in the art and are within the intended scope of the present invention. Thus, the present invention is to be limited only by the following claims.

What is claimed is:

1. A motorcycle comprising:

a frame;

a front wheel connected to said frame;

a rear wheel connected to said frame;

an engine mounted to said frame generally between said front and rear wheels; and a rocker box mounted to said engine and including a generally wedge-shaped lower section and a generally wedge-shaped upper section mounted on said lower section, whereby said upper section is generally horizontally removable from said lower section.

2. The motorcycle of claim 1, wherein said rocker box has a first side and a second side, the first side of said lower section being taller than the second side of said lower section, and the first side of said upper section being shorter than the second side of said upper section.

3. The motorcycle of claim 1, further comprising fastening a rocker assembly at least partially housed within said rocker box and removably from said rocker box.

4. The motorcycle of claim 3, further comprising fastening means releasably interconnecting said rocker assembly with said rocker box.

5. The motorcycle of claim 3, wherein said engine includes a cylinder assembly, said lower section being mounted to said cylinder assembly, said motorcycle further comprising a mounting bolt passing through a portion of said rocker assembly and threaded into a portion of said lower section.

6. The motorcycle of claim 5, wherein said mounting bolt passes through a portion of said rocker box.

7. The motorcycle of claim 3, wherein said engine includes a cylinder assembly, said cylinder assembly including a cylinder and a cylinder head, said motorcycle further comprising a mounting bolt passing through a portion of said rocker assembly and threaded into a portion of said cylinder assembly.

8. The motorcycle of claim 7, wherein said mounting bolt passes through a portion of said rocker box to capture said portion of said rocker box between said rocker assembly and said cylinder assembly.

9. A motorcycle comprising:

a frame;

an engine mounted to said frame, said engine including a cylinder assembly having a cylinder and a cylinder head;

a rocker box mounted to said cylinder assembly and including a generally wedge-shaped lower section and a generally wedge-shaped upper section mounted on said lower section and removable from said lower section in a generally horizontal direction; and a rocker assembly at least partially housed within said rocker box and separable from said rocker box.

10. The motorcycle of claim 9, wherein said rocker box includes a first side and a second side, wherein said first side of said upper section is shorter than said second side of said upper section, and said first side of said lower section is taller than said second side of said lower section.

11. The motorcycle of claim 9, further comprising fastening means releasably interconnecting said rocker assembly with said cylinder assembly.

12. A motorcycle internal combustion engine comprising:

a crankcase;

a cylinder assembly coupled to said crankcase and including a cylinder and a cylinder head; and a rocker box coupled to said cylinder assembly, said rocker box including a bottom portion mounted to said cylinder head and a top portion separable from and mounted to said bottom portion, wherein each of said top and bottom portions includes a first and a second side, wherein at least a portion of said first side of said top portion has a height that is smaller than the height of said second side of said top portion, and wherein at least a protion of said first side of said bottom portion has a height that is smaller than the height of said second side of said bottom portion.

13. The engine of claim 12, wherein said top portion of said rocker box is generally wedge-shaped.

14. The engine of claim 12, further comprising a rocker assembly at least partially housed within said rocker box and separable from said rocker box.

15. The motorcycle of claim 12, wherein said top portion of said rocker box is generally wedge-shaped and wherein said bottom portion of said rocker box is generally wedge-shaped.

16. A motorcycle comprising:

a frame;

a pair of wheels supporting said frame; and an internal combustion engine coupled to said frame and including:

a crankcase;

a cylinder assembly coupled to said crankcase and including a cylinder and cylinder head; and a rocker box coupled to said cylinder assembly, said rocker box including a bottom portion mounted to said cylinder head and a top portion separable from and mounted to said bottom portion, wherein each of said top and bottom portions includes a first side and a second side, wherein at least a portion of said first side of said top portion has a height that is smaller than height of said second side of said top portion, and wherein at least a portion of said first side of said bottom portion has a height that is smaller than the height of said second side of said bottom portion.

17. The motorcycle of claim 16, wherein said top portion of said rocker box is generally wedge-shaped.

18. The motorcycle of claim 16, further comprising a rocker assembly at least partially housed within said rocker box and separable from said rocker box.

19. The motorcycle of claim 16, wherein said bottom portion of said rocker box is generally wedge-shaped.

20. A rocker box for use on a motorcycle engine, said rocker box including a bottom portion adapted to be mounted to the engine and a top portion separable from and mounted to said bottom portion, wherein each of said top and bottom portions includes a first side and a second side, wherein at least a portion of said first side of said top portion has a height that is smaller than the height of said second side of said top portion, and wherein at least a portion of said first side of said bottom portion has a height that is smaller than the height of said second side of said bottom portion.

21. The rocker box of claim 20, wherein said top portion is generally wedge-shaped.

22. The rocker box of claim 20, wherein said bottom portion is generally wedge-shaped.

23. A motorcycle internal combustion engine comprising:

a cylinder assembly including a cylinder and a cylinder head;

a rocker mounted to said cylinder head;

a rocker assembly at least partially housed within and removably coupled to said cylinder head, said rocker assembly including a rocker support and a rocker at least partially supported by said rocker support for rotation with respect to said rocker support, said rocker defining a through-bore, said rocker support including a rocker shaft passing through said through-bore and having an indent; and a member aligned with said indent to prevent removal of said shaft from said rocker assembly.

24. A motorcycle internal combustion engine comprising:

a crankcase;

a cylinder assembly coupled to said crankcase and including a cylinder and a cylinder head; and a rocker box mounted to said cylinder head, said rocker box including a bottom portion mounted to said cylinder head and a top portion separable from and mounted to said bottom portion, wherein said bottom portion includes a first side and a second side, wherein at least a portion of said first side has a height that is smaller than the height of said second side.

* * * * *

UNITED STATES PATENT AND TRADEMARK OFFICE

CERTIFICATE OF CORRECTION

PATENT NO. : 6,296,071 B1
DATED : October 2, 2001
INVENTOR(S) : Richard M. Runte et al.

It is certified that error appears in the above-identified patent and that said Letters Patent is hereby corrected as shown below:

Claim 3,
Line 58, "removably" should be -- removable --.

Claim 12,
Line 46, "protion" should be -- portion --.

Signed and Sealed this

Twelfth Day of March, 2002

*Attest:*

*Attesting Officer*

JAMES E. ROGAN
*Director of the United States Patent and Trademark Office*